US005428968A

United States Patent [19]

Tetsukawa et al.

[11] Patent Number: 5,428,968

[45] Date of Patent: Jul. 4, 1995

[54] REFRIGERATOR SHOWCASE

[75] Inventors: Kazuo Tetsukawa, Gunma; Masaru Sekine, Tochigi, both of Japan

[73] Assignee: Sanyo Electric Co., Ltd., Moriguchi, Japan

[21] Appl. No.: 276,112

[22] Filed: Jul. 15, 1994

[30] Foreign Application Priority Data

Jul. 22, 1993 [JP] Japan ..... 5-201811
Jul. 22, 1993 [JP] Japan ..... 5-201812

[51] Int. Cl.[6] ..... A47F 3/04

[52] U.S. Cl. ..... 62/248; 49/381; 312/116; 312/229

[58] Field of Search ..... 62/248, 291; 312/116, 312/299, 405; 49/381, 408

[56] References Cited

U.S. PATENT DOCUMENTS

| | | | |
|---|---|---|---|
| 1,681,242 | 8/1928 | Klaus | 312/229 X |
| 4,753,084 | 6/1988 | Aoki | 62/248 X |
| 4,852,303 | 8/1989 | Rolek | 62/248 X |
| 4,934,098 | 6/1990 | Prouteau et al. | 49/408 X |
| 5,374,116 | 12/1994 | Borgen et al. | 312/116 |

FOREIGN PATENT DOCUMENTS

236286A3 2/1987 European Pat. Off. .

OTHER PUBLICATIONS

Patent Abstracts of Japan, vol. 14 No. 478 (M-1306) 18 Oct. 1990 & JP-A-02 192 573 (Sanyo Electric).

Patent Abstracts of Japan, vol. 15, No. 283 9M-1137) 18 Jul. 1991 & JP-A-03 099 188 (Sanyo Electric).

*Primary Examiner*—William E. Tapolcai

*Attorney, Agent, or Firm*—Darby & Darby

[57] ABSTRACT

An object of the present invention is to provide a refrigerator showcase enabling to smoothly dispose of dewing occurring on an upper surface of a glass door; the showcase in which the door includes a frame body having a form similar to a picture frame; a transparent glass mounted inside the frame body; a drainage passage formed inside the frame body located in the supported side of the door; and a water collection portion formed in a portion where the frame body contacts the upper surface of the transparent glass in the supported side of the door; whereby the drainage passage connects a space formed above the transparent glass to the machine room, and the water collection portion slopes down to the drainage passage in the open state of the door.

3 Claims, 8 Drawing Sheets

REFRIGERATOR SHOWCASE

BACKGROUND OF THE INVENTION

This invention relates to a refrigerator showcase for displaying and selling food such as ice cream.

The refrigerator showcase of this type generally cools, as disclosed in Japanese Utility Model Laid-open Application No. Hei 2-6988 (F25D23/02), a storeroom provided inside an insulating box body thereof by a cooling apparatus. The insulating box body being open upward is usually closed by a glass door capable of opening and closing. The glass door is supported in the back end of the insulating box body rotatably in the upper and lower side directions. The showcase displays and keeps food in the storeroom so as to enable to pick the food out by holding up the front side of the glass door to open it.

A refrigerator showcase of another type, as disclosed in Japanese Patent Laid-open Application No. Hei 3-30071 (F25D23/02), cools a storeroom provided inside an insulating wall thereof by a cooling apparatus. The insulating wall being open forward is usually closed by a glass door capable of opening and closing and rotatably supported by the insulating wall. The showcase displays and keeps food in the storeroom so as to enable customers to see the inside through the glass door during selecting food and open the door for picking the food out.

When such refrigerator showcases are applied for displaying and selling frozen food such as ice cream, each storeroom is cooled at freezing temperature below the freezing point, so that dewing can easily occur on the upper surface of the glass door exposing to the air. The dewing occurring on the upper surface of the glass door deteriorates the view of the inside. Furthermore, drops of dew can be splashed outward from the lowest position of the glass door when the door is opened thus making the vicinity of the showcase dirty.

In order to prevent the problems mentioned above, the conventional showcase disclosed in the Japanese Patent Laid-open Application No. Hei 3-30071 provides a glass door in which a printed heater is stuck on the opposite surface to that facing the outside. The glass door with such a heater, however, increases the cost in manufacturing. Also, the heater is less useful to prevent the frame body of the door from dewing, so that another heater can be required for prevention of the dewing to frame body. Furthermore, the heater runs hot all over the glass door so as to affect the storeroom side in temperature. In other words, the heater makes the temperature of the storeroom high, so that a load of the cooling apparatus of the showcase increases, resulting in requirement to improve the capacity of the cooling apparatus.

In addition, in conventional glass doors, for example as shown in the above-mentioned applications, each which is formed by inserting the periphery of the plate glass in the frame body, thus extremely making the assembly of the door complicate.

SUMMARY OF THE INVENTION

Therefore, for solving the above-mentioned problems in the art, an object of the present invention is to provide a refrigerator showcase enabling to easily dispose of dewing occurring on an upper surface of a glass door.

Another object of the present invention is to provide a refrigerator showcase which can control a heat effect to a storeroom and effectively prevent a frame body and plate glasses forming a door from dewing, the showcase in which the assembly line of the door can be remarkably improved.

The foregoing objects are accomplished with a refrigerator showcase including an insulating box body being open upward and forming a storeroom therein; a door supported rotatably in the upper and lower side directions and enabling to open and close so as to close the opening of the insulating box body; a cooling apparatus for cooling the storeroom; and a machine room for placing the cooling apparatus; includes the improvement in which the door is formed of a frame body having a form similar to a picture frame; a transparent glass mounted inside the frame body; a drainage passage formed inside the frame body located in the supported side of the door; and a water collection portion formed in a portion where the frame body contacts the upper surface of the transparent glass in the supported side of the door; whereby the drainage passage connects a space formed above the transparent glass to the machine room, and the water collection portion slopes down to the drainage passage in the open state of the door.

The showcase also includes the improvement in which a drip pan is provided in the machine room, and the drainage passage is always located above the drip pan irrespective of the state as to whether the door is open or closed.

In another aspect of the present invention, a refrigerator showcase including an insulating wall (insulating box body) having an opening and forming a storeroom therein; and a door capable of opening and closing so as to close the opening of the insulating wall; includes the improvement in which the door is formed of a door frame having a form similar to a picture frame; gasket fixtures fastened with screws to the inner surface of the door frame; and a transparent glass held between the door frame and the gasket fixtures.

According to yet another aspect of the present invention, a refrigerator showcase including an insulating wall having an opening and forming a storeroom therein; a door capable of opening and closing so as to close the opening of the insulating wall; a cooling apparatus for cooling the storeroom; includes the improvement in which the door is formed of a frame body having a form similar to a picture frame, and a transparent glass mounted inside the frame body; the transparent glass is formed of at least two plate glasses and metal spacers held between the peripheries of both plate glasses; the frame body includes a press wall portion contacting the periphery of the glass located outside, an outer groove formed along the periphery of the press wall portion contacting the periphery of the plate glass, being opposite to the metal spacers, and an inner groove formed along the periphery of the press wall portion, being located inside the outer groove; and the outer groove provides a heater therein and the inner groove is filled with a seal material.

BRIEF DESCRIPTION OF THE DRAWINGS

The above and other objects and features of the invention will be apparent to those skilled in the art from the following detailed description of the preferred embodiment, when considered in conjunction with the accompanied drawings, in which.

DETAILED DESCRIPTION OF THE PREFERRED EMBODIMENT

Figure 1:
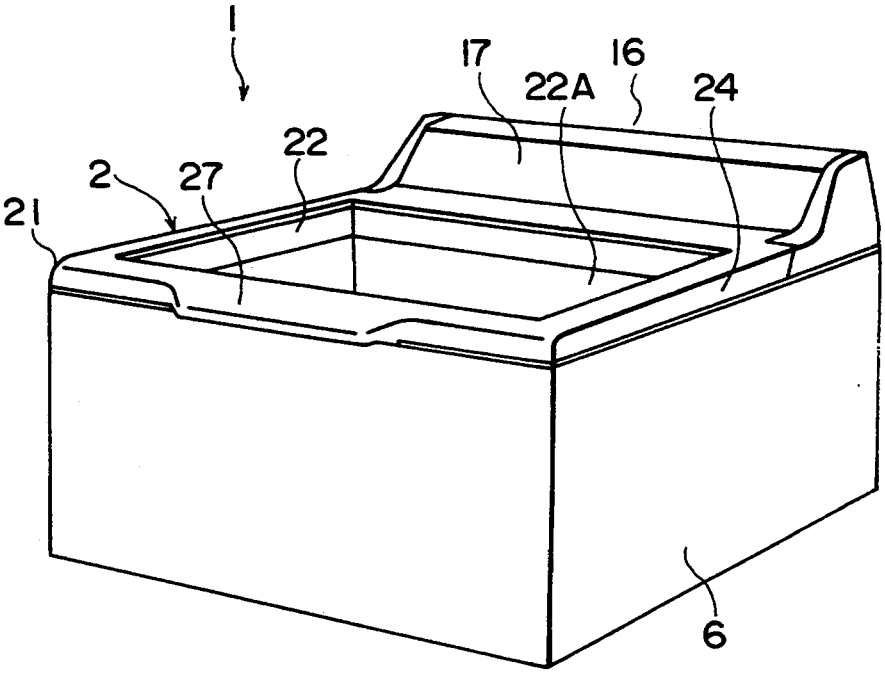
FIG. 1 is a perspective view of a refrigerator showcase according to the present invention.
Figure 2:
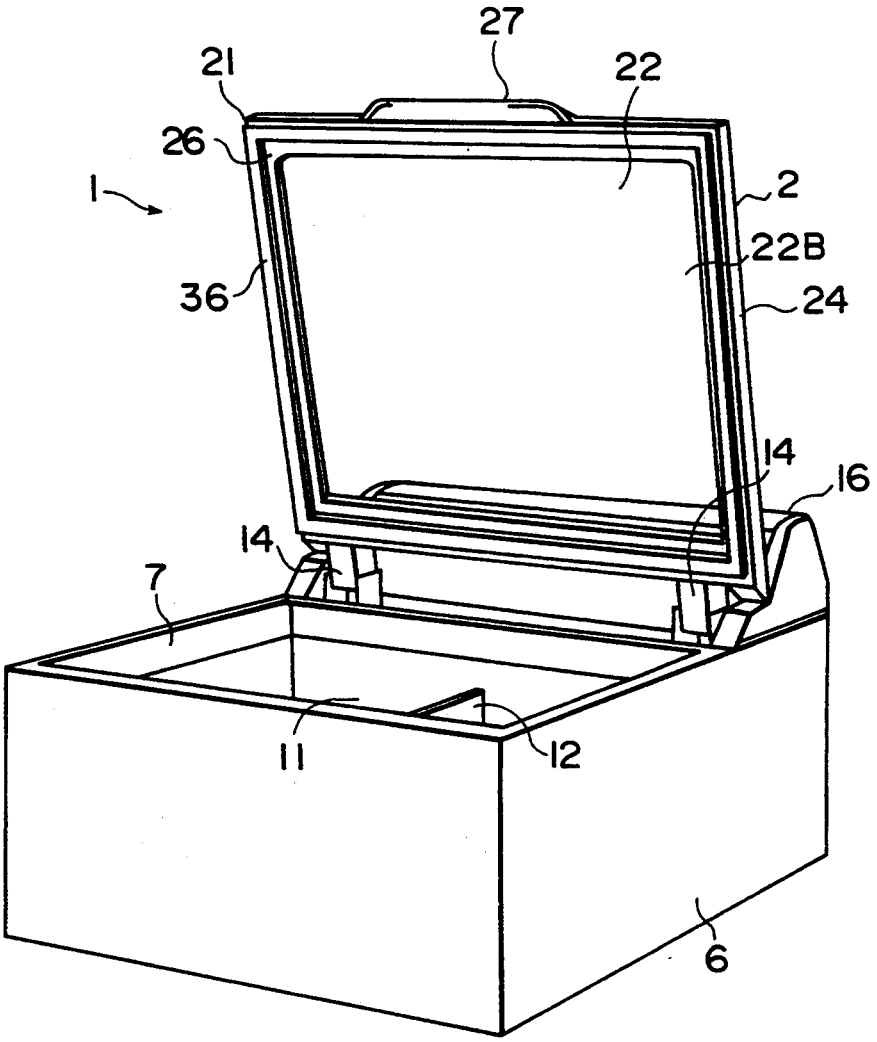
FIG. 2 is a perspective view showing an open state of a door of the refrigerator showcase according to the present invention.

Referring now to FIGS. 1 to 8, an embodiment of the present invention will be described hereinbelow.

A refrigerator showcase 1 according to the embodiment of the present invention, for example, is a compact, desk type showcase for displaying and selling ice cream frozen therein. The refrigerator showcase 1 is formed of an insulating box body 3 used as an insulating wall having an opening in the upper surface thereof, a door 2 capable of opening and closing so as to close the opening of the insulating box body from the upper side direction, and a machine room 4 provided on the back side of the insulating box body.

The insulating box body 3 is formed by filling with a heat-insulating material 8 such as a blowing polyurethane between a metal outer box 6 and an inner box 7, both which are open upward. A cooling pipe 9 constituting a part of a cooling apparatus R is provided around the side of the inner box 7 facing the heat-insulating material 8. The inside of the inner box 7 constituting a storeroom can be divided with partitions 12 and the like if necessary. Meanwhile, a compressor 13 and the like constituting the cooling apparatus R are provided in a machine room 4. A pair of hinges 14, 14 are mounted on the right and left sides of the machine room 4 facing the insulating box body 3 so as to rotatably support the back side of the door 2.

A rising portion 16 is formed behind the door 2, locating above the machine room 4. In the front of the rising portion 16, a translucent shade 17 printed with advertising letters or the like is mounted. The advertising letters are in bold relief by the light of a fluorescent lamp 18 mounted inside the rising portion 16 and behind the shade 17.

Figure 8:
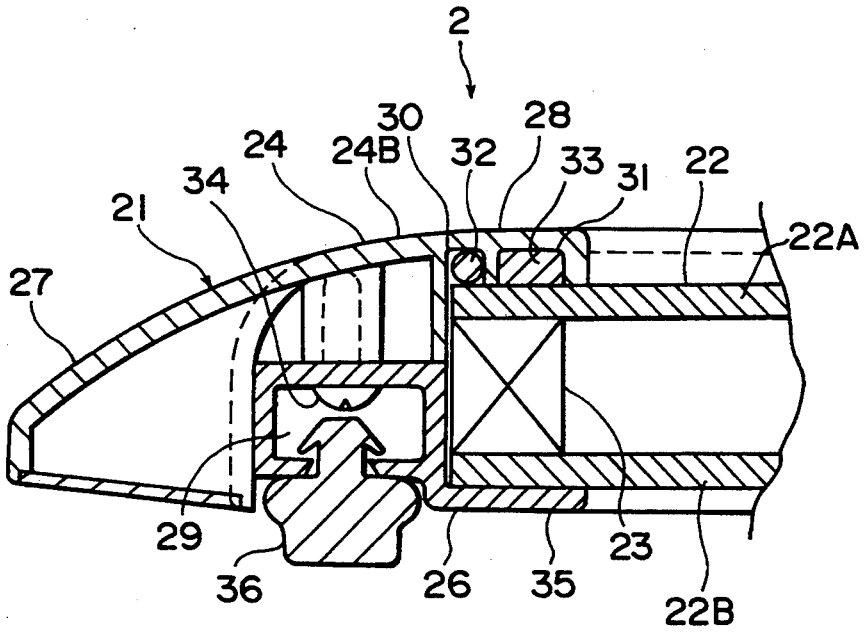
FIG. 8 is an enlarged vertical sectional view showing a front portion of the door of the refrigerator showcase according to the present invention.

On the other hand, the door 2 is formed of a frame body 21 having a form similar to a picture frame and a transparent glass 22 mounted inside the frame body 21. The transparent glass 22, as shown in FIG. 8, is a duplex layer glass which is formed of a pair of rectangular plate glasses 22A and 22B and metal spacers 23 held in the periphery between the plate glasses 22A and 22B. The space between both plate glasses 22A and 22B is sealed by a six fluoride sulfur gas, and a proper heat reflective film is stuck on the inner surface of the outer plate glass 22A.

The frame body 21 is formed of a door frame 24 having a form similar to a picture frame and being made of a hard synthetic resin and four gasket fixtures 26 made of a hard synthetic resin provided to the four side of the door frame 24. A handle portion 27 is formed on the front side 24B of the door frame 24, and the back side 24A of the door frame 24 is fixed by the hinges 14, 14. The door frame 24 forms a press wall portion 28 by successively projecting inside. On the back side of the press wall portion 28, an outer groove 30 and an inner groove 31 located inside the outer groove 30 are formed along the periphery of the door 2 as shown in FIG. 8. Then, a heater 32 constituted of electric heater wires is inserted in the outer groove 30, and a sealing material 33 such as a soft blowing vinyl chloride is filled inside the inner groove 31. On the other hand, each of the gasket fixtures 26 includes a coupling groove 29 being open downward, and an inner flange portion 35 enlarged inside from the coupling groove 29. Then, a gasket 36 is mounted in the coupling groove 29 by inserting it in the coupling groove 29.

In assembly line of the door 2, the door frame 24 is turned out and the heater 32 and the sealing material 33 are respectively put in the outer groove 30 and the inner groove 31. Next, the periphery of the transparent glass 22 is located along the back surface of the press wall portion 28 and the gasket fixtures 26 are placed thereon to fix the gasket fixtures 26 on the inner surface of the door frame 24 by screws 34. Thus, the transparent glass 22 is mounted so as to be held between the press wall portion 28 of the door frame 24 and the inner flange portions 35 of the gasket fixtures 26. Accordingly, the assembly of the door 2 is completed in a simple manner. After that, the door 2 is supported by the hinges 14, 14 as mentioned above. In addition, the outer groove 30 formed on the back side of the press wall portion 28 of the door frame 24 is located along the metal spacers 23 of the transparent glass 22.

On the other hand, in the central portion of the back side 24A, corresponding to the side placing the hinges 14, 14 (supported side) of the door frame 24, a notched portion 37, taking a form of a groove being open forward and downward, is formed. Then the gasket fixture 26A placed on the back side of the door frame 24 is opposite to the notched portion 37 of the door frame 24 so as to space each other out, thus forming a drainage passage portion 38 therein. The front end of the drainage passage portion 38 is open above the transparent glass 22 through an opening 39placed on the end surface of the press wall portion 28 facing the upper surface of the plate glass 22A of the transparent glass 22, while the back end of the drainage passage portion 38 is open downward to the machine room 4 through an opening 41. Accordingly, the drainage passage portion 38 connects the space of the upper surface of the transparent 22 to the machine room 4.

Figure 3:
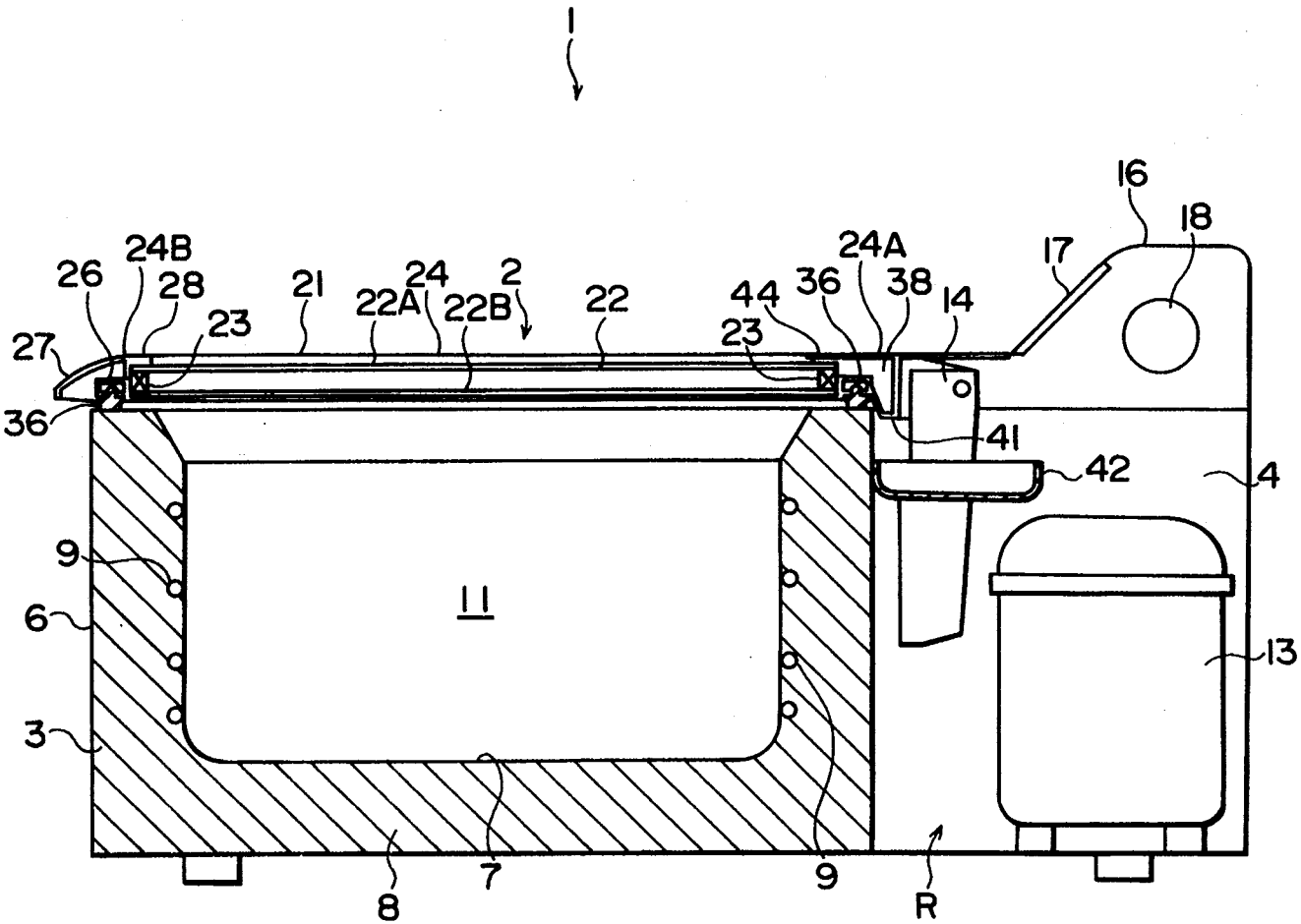
FIG. 3 is a vertical sectional view of the refrigerator showcase according to the present invention.
Figure 4:
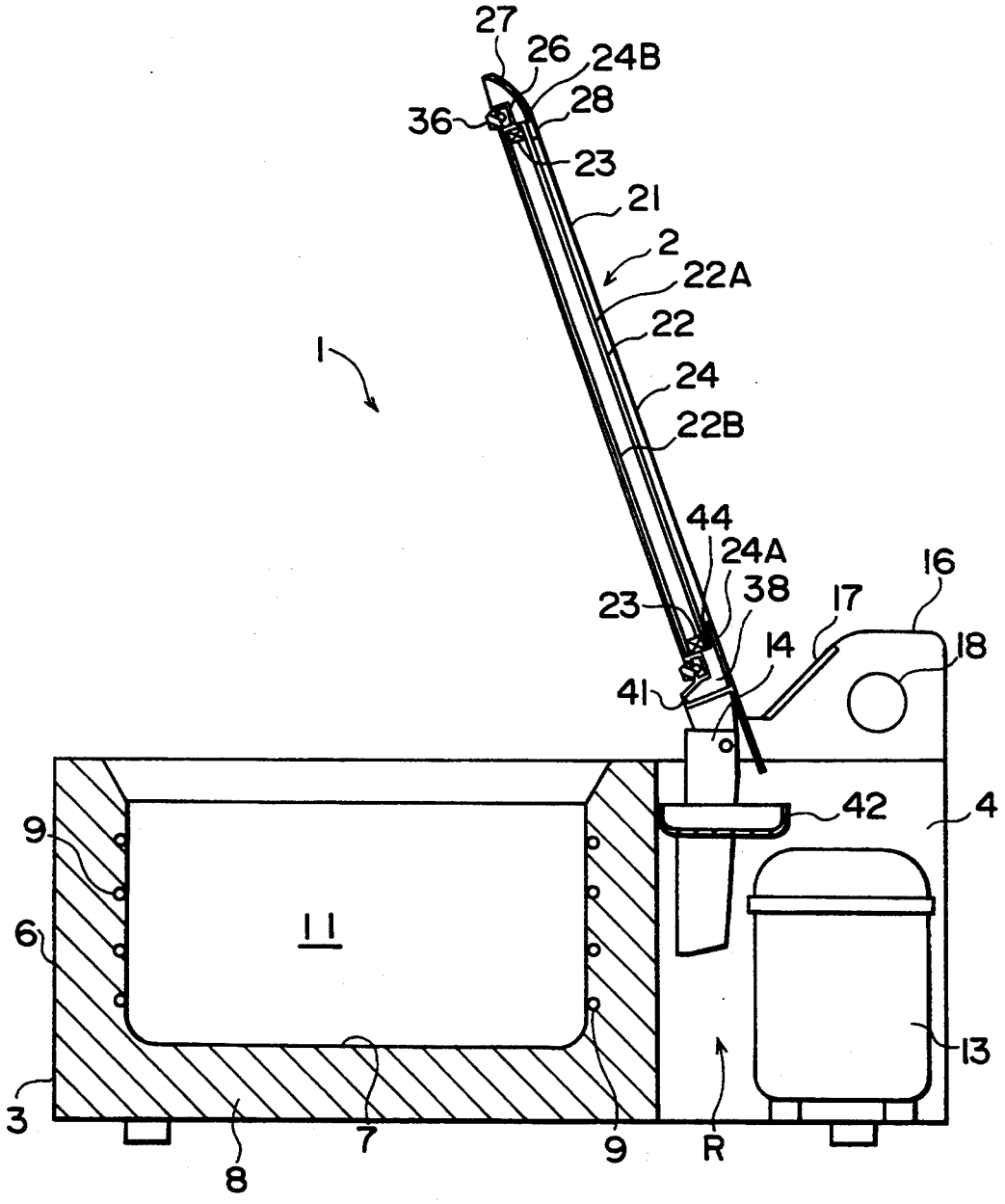
FIG. 4 is a vertical sectional view showing the open state of the door of the refrigerator showcase according to the present invention.
Figure 5:
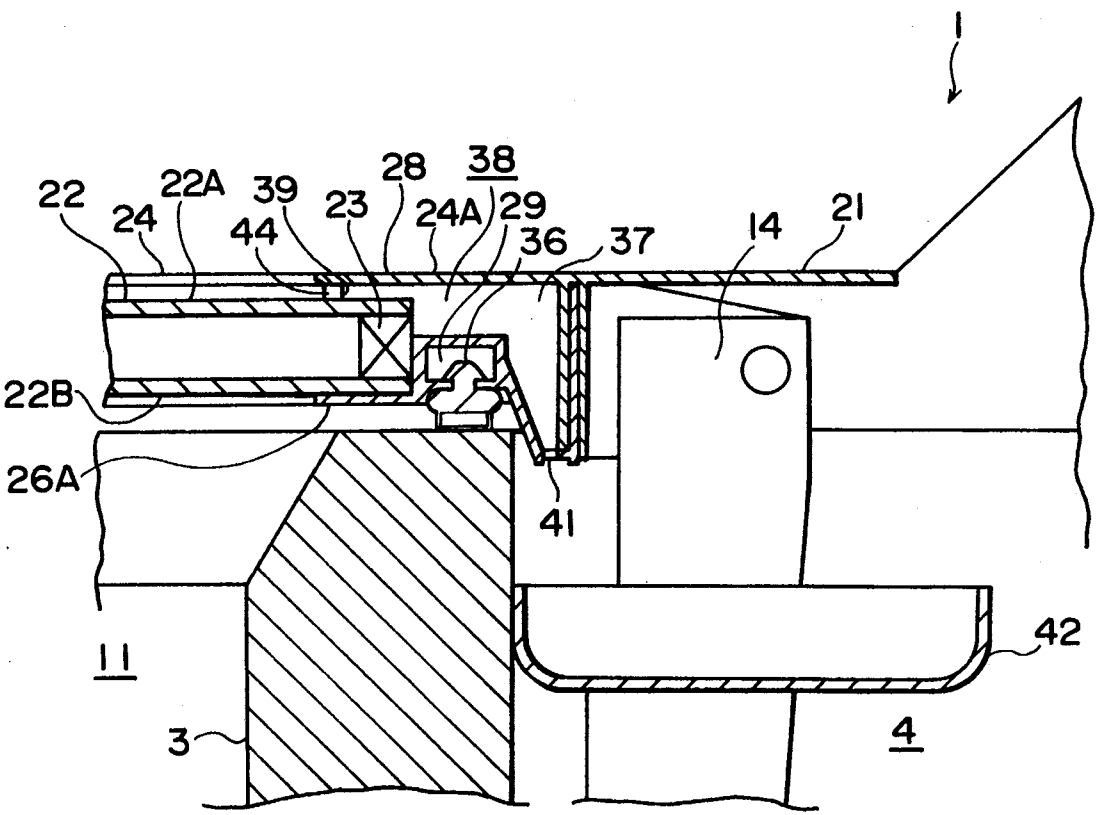
FIG. 5 is an enlarged vertical sectional view showing a drainage passage portion of the refrigerator showcase according to the present invention.
Figure 6:
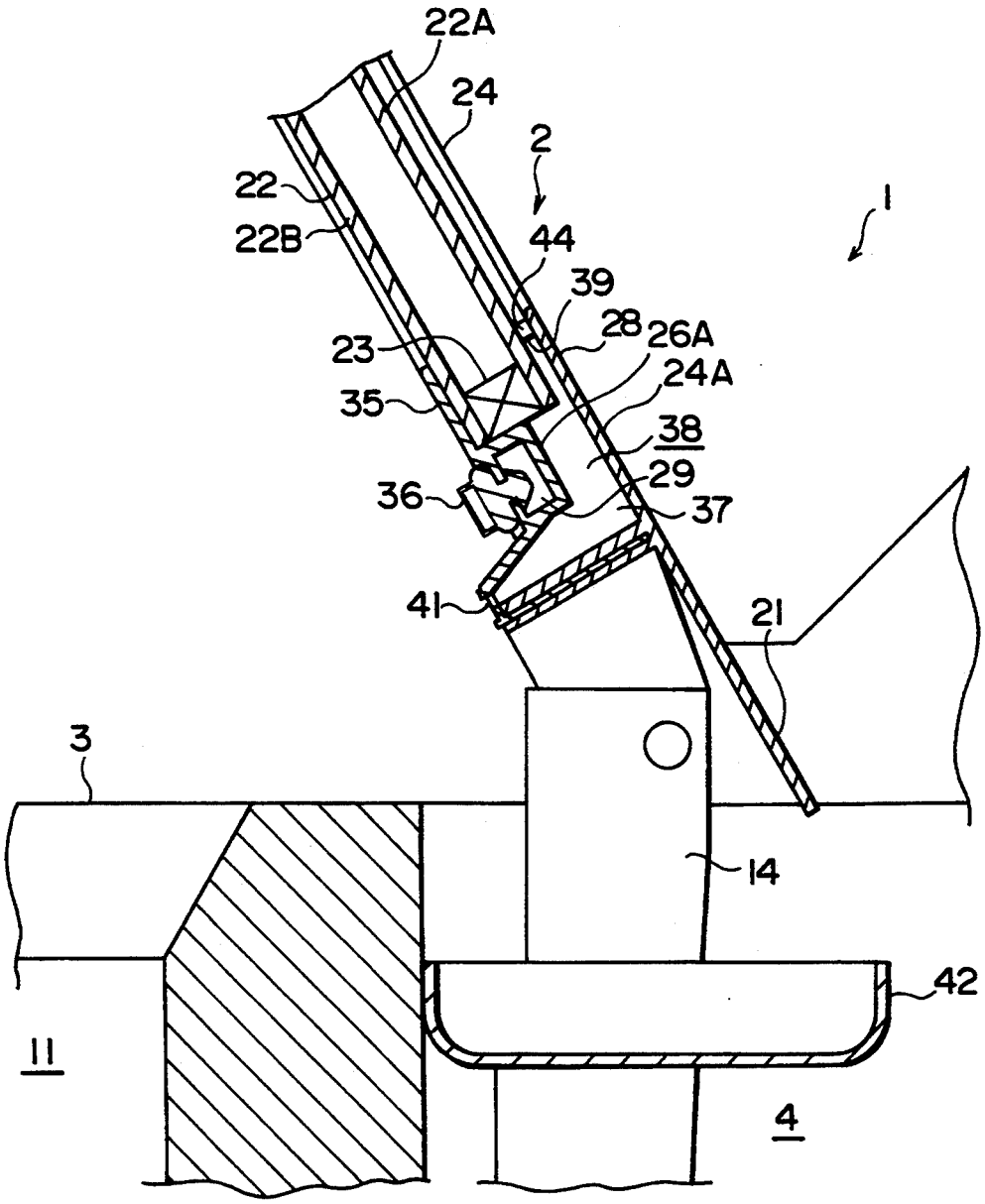
FIG. 6 is an enlarged vertical sectional view showing the drainage passage portion of the refrigerator showcase in the open state of the door according to the present invention.
Figure 7:
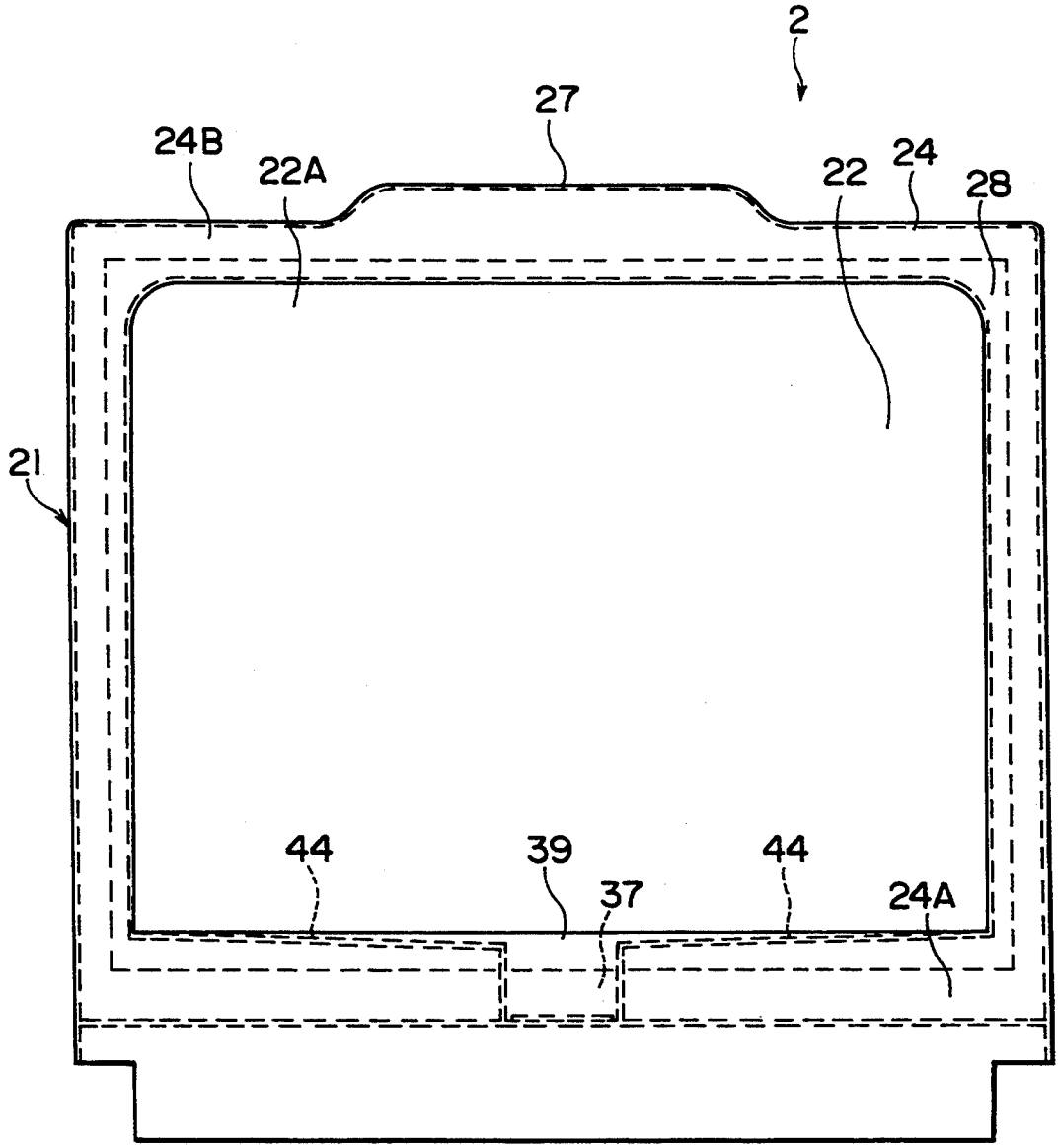
FIG. 7 is a plan view showing the door of the refrigerator showcase according to the present invention.

In the machine room 4, a drip pan 42 is placed under the opening 41 of the drainage passage portion 38. In both states of the door 2 being closed as shown in FIGS. 3 and 5, and of the door 2 being open as shown in FIGS. 4 and 6, a portion of the drip pan 42 is at least placed under the opening 41. In the state of the door 2 being open as shown in FIGS. 4 and 6, the end surface of the press wall portion 28 on the back side 24A of the door frame 24 gradually slopes down from both side thereof to the opening 39 of the drainage passage portion 38 so as to form a water collection portion 44.

In the above-mentioned structure, when the compressor 13 is driven, a condensed refrigerant flows through the cooling pipe 9 by reducing the pressure so as to cool the inner box 7 by evaporating in the cooling pipe 9. Thus, the ice cream stored in the storeroom 11 keeps freezing at a temperature below −20° C. or so. At this time, the transparent glass 22 of the door 2 is also cooled, so that the upper surface of the plate glass 22A exposing to the air can be easily dewed by humidity in the air.

On this condition, when the door 2 is opened for picking up the ice cream by holding up the handle portion 27, the dewing water flows down to the back side 24A of the door frame 24. The dewing water reaching the back side 24A of the press wall portion 28 is collected along the slope of the water collection portion 44 formed on the end surface of the press wall portion 28 to the opening 39 of the drainage passage portion 38 so as to flow from the opening 39 into the drainage passage portion 38. Then, the dewing water passing through the drainage passage portion 38 reaches the opening 41 placed below the back end of the drainage passage portion 38 and is dropped into the machine room 4.

At this time, since the drip pan 42 is placed under the opening 41, the dewing water dropped from the opening 41 is received in the drip pan 42 and discharged outside through a drain pipe not shown. In addition, when the door 2 is closed afterward, the drip pan 42 is always located under the opening 41, so that the dewing water occurred on the upper surface of the plate glass 22A and dropped from the opening 41 during opening and closing operation can be completely received in the drip pan 42.

That is, the dewing water formed on the plate glass 22A can be smoothly removed so that it is not required to stick the printed heater or the like on the overall surface of the transparent glass 22 as described in the conventional showcase. Or the heating value can be reduced if the printed heater or the like is stuck thereon. Accordingly, the showcase according to the embodiment is not required to increase the size of the cooling apparatus R in consideration of the heat effect from the printed heater or the like, thus achieving a decrease in the size of the refrigerator showcase 1.

In addition, it will be understood that the dewing water normally flowing from the opening 39 into the drainage passage portion 38 in the state of the door 2 being closed should be also received from the opening 41 into the drip pan 42.

On the other hand, since the metal spacers 23 mounted inside the door 2 have a good heat conductivity, the temperature thereof is reduced by cooling effect from the storeroom 11, so that the door frame 24 placed above the metal spacers 23 can be also subjected to the cooling effect, thus easily occurring dewing on the upper surface of the door frame 24.

However, the outer groove 30 is formed along the metal spacers 23, so that the heater 32 put in the outer groove 30 heats not only the door frame 24 directly, but also the metal spacers 23 through the plate glass 22A. In addition of direct heating to the door frame 24, the cooling effect from the metal spacers 23 is controlled, thus effectively preventing dewing onto the upper surface of the door frame 24. Furthermore, by heating the metal spacers 23, the heat is also conducted over a wide range of the outer plate glass 22A, so that the dewing onto the upper surface of the plate glass 22A is also controlled. Especially in this case, the plate glass 22A does not heat by itself, therefore, the heat effect to the storeroom 11 can be reduced.

In addition, the sealing material 33 is put in the inner groove 31 located inside the heater 32, so that the dewing water increased on the upper surface of the plate glass 22A can not penetrate into the side of the heater 32, thus preventing electric leakage troubles and the like occurred by inundation of the heater 32.

As described in detail above, according to the present invention, the dewing water on the upper surface of the transparent glass of the door reaches the water collection portion by opening the door or the like, and is collected along the slope of the water collection portion to the drainage passage portion so as to be discharged from the drainage passage portion into the machine room, so that the dewing water on to upper surface of the transparent glass can be smoothly removed without sticking the printed heater or the like on the transparent glass, thus insuring the view of the inside. Accordingly, the showcase according to the present invention is not required to increase the size of the cooling apparatus in consideration of the heat effect from the printed heater or the like, thus achieving a decrease in the size of the refrigerator showcase.

Further, in the showcase according to the present invention, the drip pan is provided in the machine room, and the drainage passage is open above the drip pan irrespective of the state as to whether the door is open or closed, so that the dewing water discharged from the drainage passage can be completely received in the drip pan, thus certainly preventing such inconvenience as the dewing water makes the vicinity of the showcase dirty.

In addition, according to the present invention, the door is assembled so as to hold the transparent glass between the door frame and gasket fixtures by placing the transparent glass inside of the door frame and fastening the gasket fixtures with the screws to the inner surface of the door frame, thus remarkably improving the assembly line of the door.

Furthermore, according to the present invention, the outer groove is formed along the metal spacers on the surface of the press wall portion of the door frame attached to the outer plate glass so as to put the heater therein, thereby not only directly heating the door frame, but also heating the metal spacers through the plate glass. Accordingly, the cooling effect conducted from the storeroom through the metal spacers to the door frame can be controlled, thus effectively preventing the dewing to the door frame on the whole.

Especially, by heating the metal spacers, the heat generated from the heater is conducted over a wide range of the outer plate glass, thus controlling the dewing to the plate glass. In this case, the heating is not occurred from the surface of the plate glass different from the conventional showcase in which the plate glass is heated by sticking the printed heater or the like thereon, so that the heat effect to the storeroom can be reduced. In addition, since the sealing material is put in the inner groove located inside the outer groove, the dewing water can not penetrate to the heater even if the dewing is occurred on the surface of the plate glass, thus preventing electric leakage troubles and the like occurred by inundation of the heater.

What is claimed is:

1. A refrigerator showcase comprising an insulating box body being open upward and forming a storeroom therein; a door supported rotatably in the upper and lower side directions and enabling to open and close so as to close the opening of said insulating box body; a cooling apparatus for cooling said storeroom; and a machine room for placing said cooling apparatus; the showcase wherein said door comprises a frame body having a form similar to a picture frame, a transparent glass mounted inside said frame body, a drainage passage formed inside said frame body located in the supported side of said door, and a water collection portion formed in a portion where said frame body contacts the upper surface of said transparent glass in the supported side of said door, whereby said drainage passage connects a space formed above said transparent glass to said machine room, and said water collection portion slopes down to said drainage passage in the open state of said door.

2. A refrigerator showcase according to claim 1, wherein a drip pan is provided in said machine room, and said drainage passage is located above said drip pan is always located above the drip pan irrespective of the state as to whether the door is open or closed.

3. A refrigerator showcase comprising an insulating box body being open upward and forming a storeroom therein; a door supported rotatably in the upper and lower side directions and enabling to open and close so as to close the opening of said insulating box body; a cooling apparatus for cooling said storeroom; and a machine room for placing said cooling apparatus; the showcase wherein said door is formed of a frame body having a form similar to a picture frame; a transparent glass mounted inside said frame body; a drainage passage formed inside said frame body located in the supported side of said door; and a water collection portion formed in a portion where said frame body contacts the upper surface of said transparent glass in the supported side of said door;

said transparent glass is formed of at least two plate glasses and metal spacers held between the peripheries of both plate glasses;

said frame body includes a press wall portion contacting the periphery of the glass located outside; an outer groove formed along the periphery of said press wall portion contacting the periphery of the plate glass, being opposite to said metal spacers; and an inner groove formed along the periphery of said press wall portion, being located inside said outer groove;

said drainage passage connects a space formed above said transparent glass to said machine room, and said water collection portion slopes down to said drainage passage in the open state of said door; and said outer groove provides a heater therein and the inner groove is filled with a seal material.

* * * * *